United States Patent [19]

Rodgers

[11] Patent Number: 4,697,483

[45] Date of Patent: Oct. 6, 1987

[54] TOOL FOR ATTACHING AND DETACHING SPRING CLIP FROM SHAFT

[76] Inventor: Herman R. Rodgers, P.O. Box 43, Ellerslie, Ga. 31807

[21] Appl. No.: 808,179

[22] Filed: Dec. 12, 1985

[51] Int. Cl.[4] ..... B25B 7/02

[52] U.S. Cl. ..... 81/418; 81/424; 81/426; 29/229

[58] Field of Search ..... 29/268, 229, 225; 81/421, 422, 423, 424, 418, 420, 424.5, 426, 426.5, 3.08

[56] References Cited

U.S. PATENT DOCUMENTS

| | | | |
|---|---|---|---|
| 437,589 | 9/1890 | Gibson | 81/420 |
| 2,588,687 | 3/1952 | Ajouelo | 81/3.08 |
| 2,592,978 | 4/1952 | Trimboli | 81/177.2 |
| 2,602,357 | 7/1952 | Nash | 81/426.5 |
| 4,416,045 | 11/1983 | Staten | 29/229 |

*Primary Examiner*—Frederick R. Schmidt
*Assistant Examiner*—Bradley I. Vaught
*Attorney, Agent, or Firm*—Arthur G. Yeager

[57] ABSTRACT

A tool comprising two jaws, the first jaw having a seat for receiving a shaft to which a split ring clip is to be attached or detached, and the second jaw having a head with two selective indexed positions, the first position for detaching the clip and having prong means adapted to contact the ends of the clip, and the second position for attaching the clip and including a seat for holding the clip with its open side facing the first jaw, a receptacle to catch the clip when detached, and means for moving said jaws together in meshing relationship.

18 Claims, 9 Drawing Figures

TOOL FOR ATTACHING AND DETACHING SPRING CLIP FROM SHAFT

BACKGROUND OF THE INVENTION

Mechanical power transmission elements, such as gears, pulleys, wheels, etc., are frequently mounted on a shaft and must be restrained from sliding off the shaft by means of a retainer clip mounted in a circumferential groove on the shaft. The clip is usually a ring from which a portion has been removed. The remaining portion of the ring can be sprung apart slightly to slide it over a circular shaft which has an outside diameter closely approaching the inside diameter of the ring. The difficulty with attaching such a ring is the awkwardness of holding the ring, usually with pliers, while giving the ring a sharp tap with a hammer to spring apart the ends of the clip and get the clip to slide into place. In detaching the ring a forked instrument is placed against the ends of the ring and a tap with a hammer is required to remove the clip, which frequently flies off the shaft so rapidly in an unpredictable direction that it is lost. There clearly has been a need for a simple system for detaching and attaching such clips.

It is an object of this invention to provide a tool for attaching or detaching a split ring spring clip from a shaft. It is another object to provide a manual tool for such purposes. Still other objects will be apparent from the more detailed description which follows.

BRIEF DESCRIPTION OF THE INVENTION

This invention relates to a tool for assembling or disassembling a split ring spring clip from a shaft comprising two cooperating opposing jaws; the first jaw including a first seat means for receiving the shaft, and the second jaw having a movable head indexed to two operating positions; the first position providing prong means for engaging the free ends of the clip and the second position providing a second seat means for engaging the clip with the free ends of the clip facing outwardly for assembly to the shaft, and means for moving the jaws together.

In a specific embodiment the tool of this invention includes a pair of pivotal handles, like a pair of pliers and the movable head is indexable by means of a spring biased ball that engages either of two recesses to cause the rotatable head to be in one or another operating position. In another embodiment, the first seat means is a semicylindrical seat with a slot in the seat to accommodate the split ring when in place on the shaft, and includes a small receptacle beneath the seat means to catch the ring when detached from the shaft.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THIS INVENTION

Figure 1:
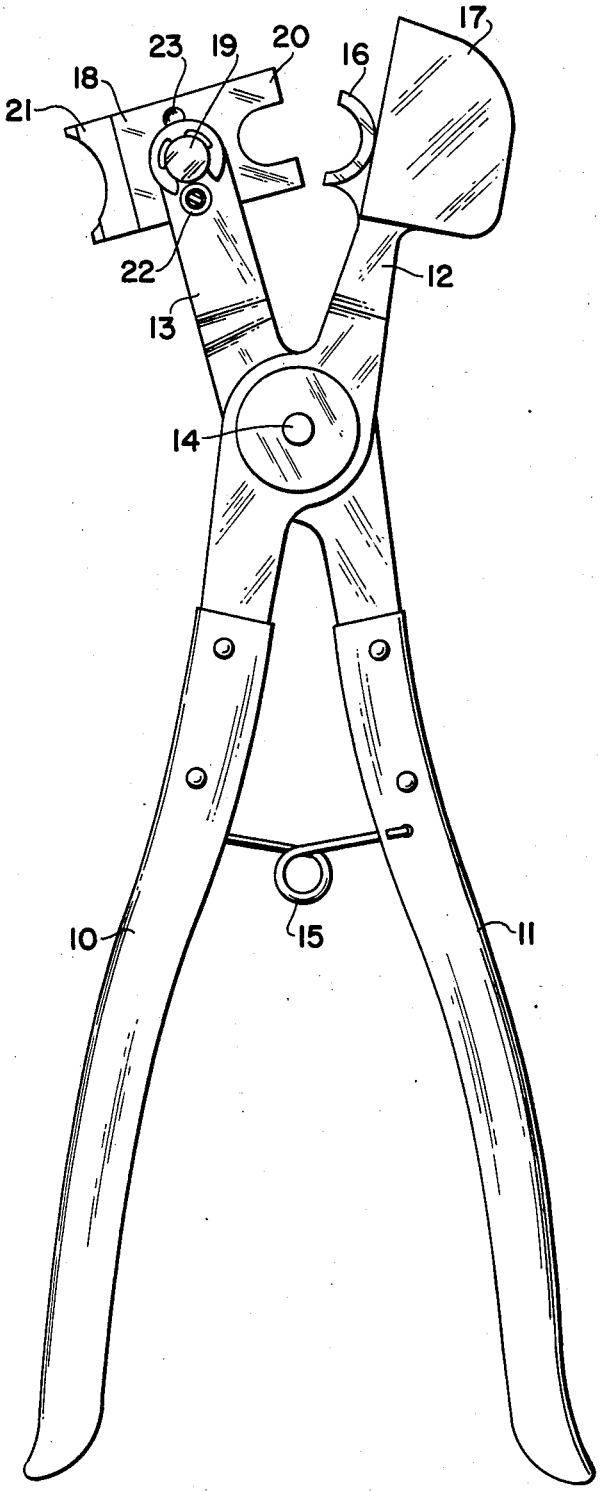
FIG. 1 is a top plan view of the tool in the form of pliers in accord with this invention.
Figure 2:
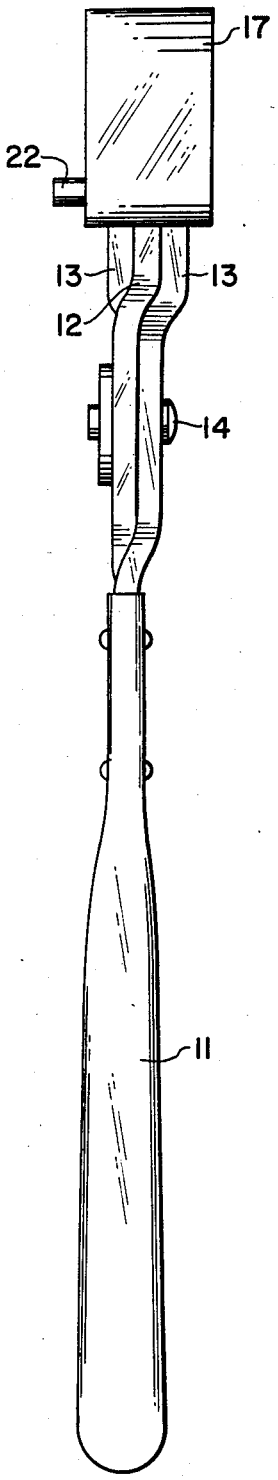
FIG. 2 is a front elevational view of the tool of FIG. 1.

This invention is illustrated in a preferred embodiment in FIGS. 1 and 2. In this embodiment the tool is shown as a pair of pliers having first and second handles 10 and 11 connected to first and second jaws 12 and 13 through pivot 14. By squeezing handles 10 and 11 together, jaws 12 and 13 move toward each other. Spring 15 attached to handles 10 and 11 serves the purpose of pushing handles 10 and 11 apart when the tool is not in use, and thereby opens jaws 12 and 13.

First jaw 12 includes a semicylindrical seat 16 which is designed to receive the shaft from which a split ring retainer clip is to be removed. Behind seat 16 is a small receptacle 17 to catch the clip when it is sprung loose from the shaft. Detailed views in FIGS. 6–9 show the relationship of the tool to a shaft 38 and a split ring retainer clip 17.

Second jaw 13 includes a rotatable head 18 which is pivoted around pin 19 and can be indexed to either of two positions by the action of a spring biased ball 22 being caught by either of two recesses 23 (only one being visible in FIG. 1). The first position for head 18 is that shown in FIG. 1 wherein end portion 20 is used to detach the split ring retainer clip from the shaft onto which it is clamped. The second position is taken when head 18 is rotated 180° from that shown in FIG. 1 so that end portion 21 faces jaw 12 and shaft seat 16. In this second position a split ring retainer clip is held by end portion 21 while it is forced onto the shaft to serve its purpose of retaining a power transmission element, such as a gear, pulley, wheel, or the like, on the shaft.

Figure 3:
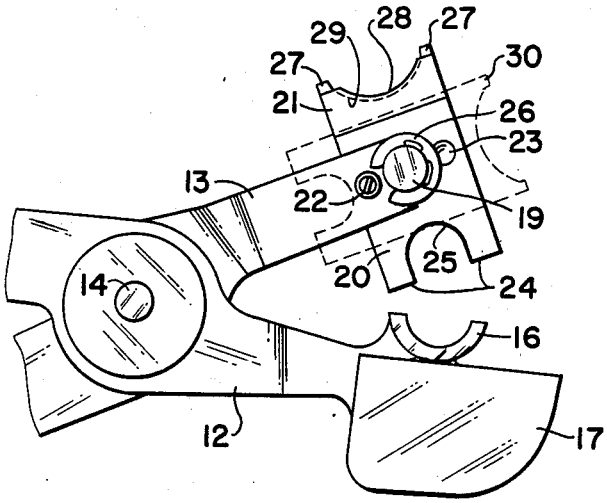
FIG. 3 is an enlarged partial plan view of the jaws of the tool of FIG. 1.
Figure 4:
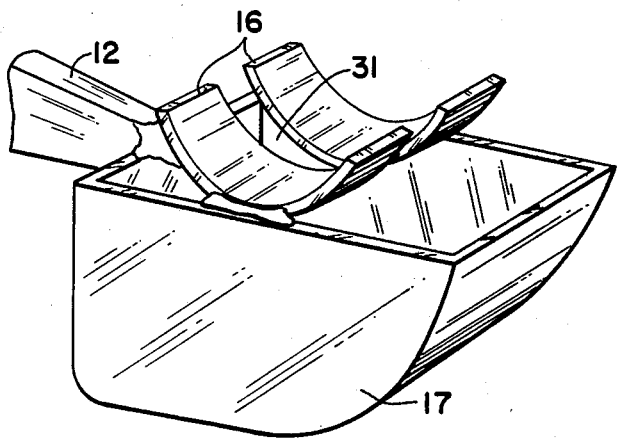
FIG. 4 is an enlarged perspective view of the fixed jaw of the tool of FIG. 1.
Figure 5:
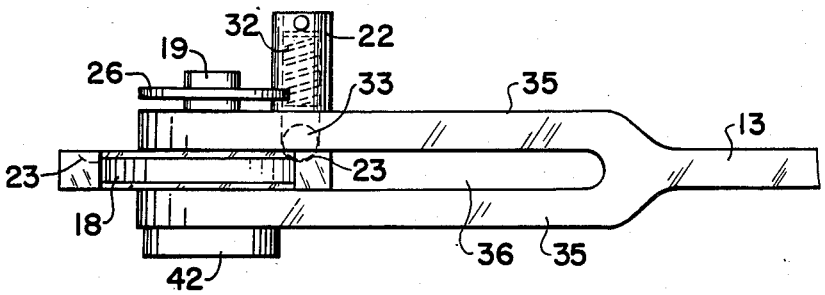
FIG. 5 is an enlarged front elevational view of the other jaw of the tool of FIG. 1.

In FIGS. 3–5 there are enlarged views of jaws 12 and 13 to show the details of the tool of the invention. As seen best in FIG. 5 jaw 13 is shown as a bifurcated member with two parallel arms 35 separated by space 36. Rotatable head 18 is a generally rectangular plate movable through space 36 and rotating about pin 19 which passes through head 18 and both of arms 35. Pin 19 is held in place by enlarged head 42 on one end and a retainer ring 26 on the other end. In order for head 18 to fit snugly between arms 35 without wobbling when it is in use, washers may be employed between the surfaces of head 18 and arms 35, bosses may be machined on head 18 or arms 35, or other well known machine engineering elements or features may be used. Head 18 has two ends 20 and 21 that may be optionally positioned to perform their separate functions. End portion 20 is employed to remove a retainer clip from a shaft and end portion 21 is employed to attach such a retainer clip to the shaft. These two positions are capable of being indexed by feel when rotating head 18 about pivot pin 19. A spring loaded ball 22 is mounted on one of arms 35 and two circular recesses 23 are formed in head 18, such that a recess is available to be engaged with ball 22 when head 18 is rotated 180°. The seating of ball 22 in a recess 23 can be felt as a vibration, permitting the operator to be sure of the proper positioning of head 18 with visual inspection. In the view of FIG. 3, end portion 20 is in the operating position and ball 22 is seated in one of recesses 23. When end portion 21 is to be used, head 18 is rotated manually through 180° so that the other of recesses 23 is under ball 22. The view of head 18 in broken lines 30 shows head 18 rotated 90° from the position in solid lines in FIG. 3.

End portion 20 has two prongs 24 separated by a generally semicircular notch 25. Prongs 24 are spaced apart sufficiently to engage the ends of the split ring retainer clip clamped on a shaft. The size and shape of notch 25 is such that it will slide over the shaft while prongs 24 are disengaging the clip from the shaft. It can be seen in FIG. 4 that shaft seat 16 is made with a central slot or opening 31 and with receptacle 17 behind seat 16. As jaws 12 and 13 close on each other forcing the split ring retainer clip off the shaft, the clip will spring away from the shaft with great speed. The clip is positioned in slot 31 and when it springs away from the shaft it will be caught by receptacle 17.

End portion 21 also has two prongs 27 separated by a generally semicircular notch 28 containing a groove 29 extending generally from one to the other of prongs 27. This end portion 21 is employed when assembling a split ring retainer clip onto a shaft. The clip is seated in groove 29 with the free ends of the clip facing outward to engage the shaft as jaw 13 is closed upon jaw 12.

Figure 6:
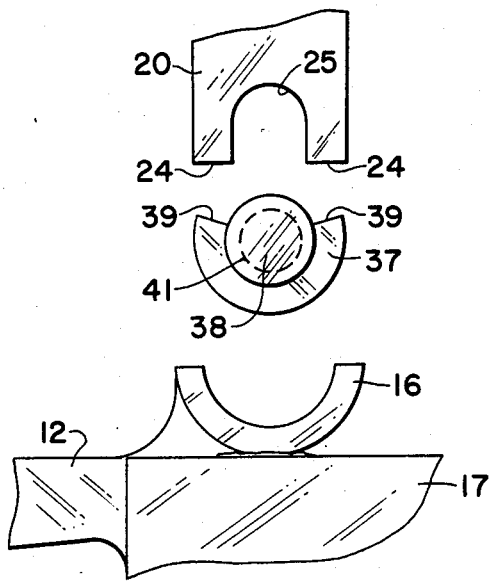
FIG. 6 is an enlarged partial side view illustrating the operation of the tool in detaching a spring clip from a shaft.
Figure 7:
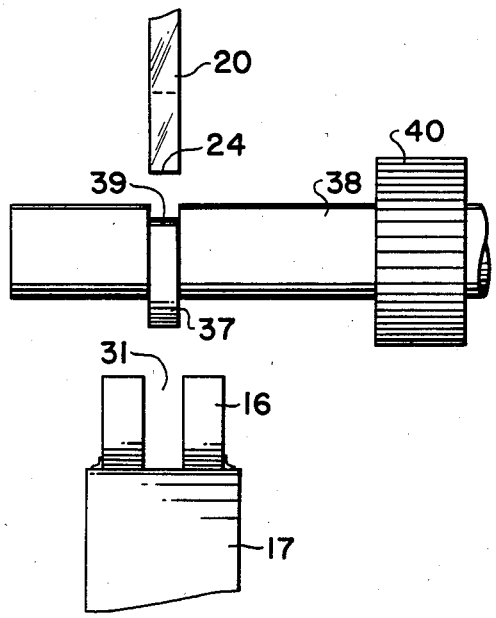
FIG. 7 is a front view of the tool depicted in FIG. 6.

In FIGS. 6 and 7 the manner in which the tool of this invention operates to remove a split ring retainer clip 37 from a shaft 38 is illustrated. Shaft 38 has a circumferential groove 41 to receive a split ring retainer clip 37 which prevents clip 37 as well as any machine element, such as gear 40, from sliding off shaft 38. Clip 37 is clamped onto shaft 38 by reason of the inherent springiness of clip 37. Ends 39 are spaced apart linearly less than the diameter of groove 41, thus requiring that ends 39 be forced outwardly to remove clip 37 from shaft 38 or to attach clip 37 to shaft 38. FIGS. 6 and 7 show the removal of clip 37 from shaft 38. Head 18 is rotated so that end portion 20 faces jaw 12 with shaft seat 16 and receptacle 17 rigidly affixed thereto. In this instance jaw 12 should preferably be below end portion 20 so that when clip 37 is removed from shaft 38 it will fall into receptacle 17. As end portion 20 descends toward shaft 38 and clip 37 with ends 39 facing upwardly, prongs 24 will contact ends 39 and notch 25 will slide through groove 41 without obstruction. Clip 37 will enter slot 31 while shaft 38 rests on seat 16. Eventually as jaws 12 and 13 close more on each other, prongs 24 will push downwardly on ends 39 causing them to spring apart as they move past the diameter of groove 41, and then spring back toward each causing clip 37 to be forcibly discharged from shaft 38. Receptacle 17 will catch clip 37 so it may be used again.

Figure 8:
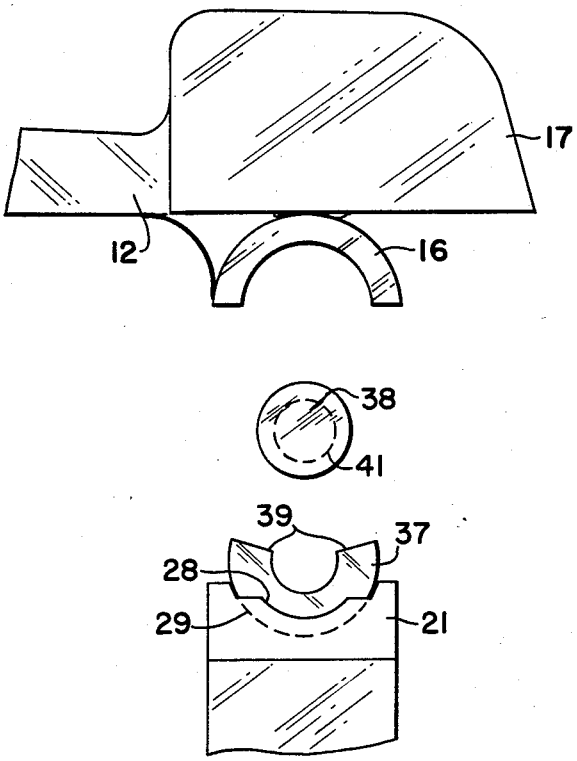
FIG. 8 is a partial side view illustrating the operation of the tool in attaching a spring clip to a shaft.
Figure 9:
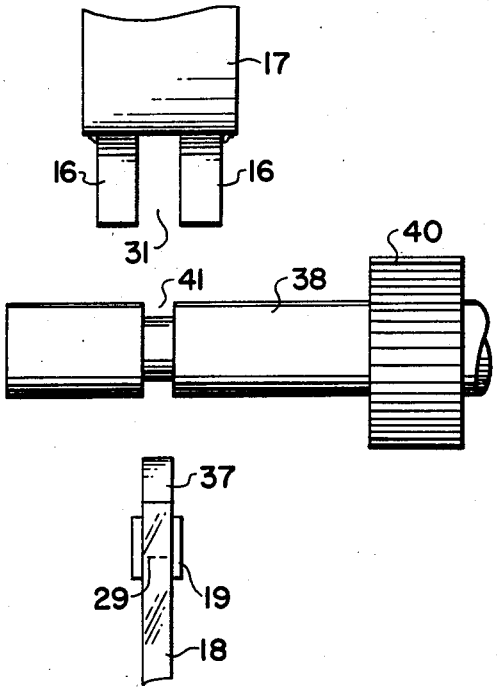
FIG. 9 is a front view of the tool depicted in FIG. 8.

In FIGS. 8 and 9 there is shown the manner in which this tool attaches spring clip 37 onto shaft 38. In this instance the orientation of jaws 12 and 13 is reversed from that shown in FIGS. 6 and 7. Here jaw 13 is below jaw 12. End portion 21 of head 18 is moved into operating position facing jaw 12 above, and shaft 38 is between jaws 12 and 13. Split ring retainer clip 37 is positioned in groove 29 of semicircular notch 28 with ends 39 facing upwardly. As jaws 12 and 13 are closed upon each other ends 39 will enter groove 41 and will be caused to spring apart to pass over the diameter of groove 41. When ends 39 pass over the diameter of groove 41 they will spring toward each other clamping clip 37 onto groove 41 of shaft 38. Preferably, end portion 21 of head 18 is magnetized so that split ring retainer clip 37 may be secured thereto during the operation of attaching clip 37 to shaft 38. With end portion 21 magnetized, jaw 13 may be oriented to be above or below shaft 38 while attaching clip 37 thereto.

There are other methods than those shown for attaching rotating head 18 to jaw 13 and indexing it to take two positions. For example, jaw 13 need not be bifurcated, and head 18 may be attached to one side or the other of jaw 13 and rotated by a ratchet device to any selected position. Also, head 18 may be L-shaped requiring only a 90° rotation to change between the two indexed positions. Still other mechanical actions and elements can be employed to provide the necessary movements and positions for the proper functioning of this invention.

The invention has been described mainly as a hand tool in the form of pliers to move jaws 12 and 13 together. It is to be understood that other means for moving jaws 12 and 13 together may be used, e.g., the jaws can be mounted on a press with one jaw on the bed and the other on the movable platen. Alternatively, the two jaws could be mounted on two faces of a clamp which is opened and closed by screw means, lever action, or any other device for closing two jaws onto each other.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A tool for assembling and disassembling a split-ring retainer clip having free ends from a shaft comprised a pair of pivotally connecting handles having a first jaw on one said handle and a second jaw on another said handle, said jaws being oppositely facing and cooperating with each other in several different movable positions of said second jaw on said other handle, said first jaw including a first seat means for receiving a shaft, and said second jaw having a head movably indexable on said other handle between two operating positions with said first jaw, said head in a first said position having prong means for engaging free ends of a split-ring retainer clip to disassemble same from a shaft, and said head in a second said position having a second seat means to nestingly and substantially fully receive a split retainer clip with its free ends facing outwardly for assembly of a split-retainer clip to a shaft, said handles being adapted to be selectively manipulated for moving said jaws together and away from each other, wherein said first seat means includes a spaced pair of semicircular elements extending substantially parallel to each other and providing a slot therebetween to permit the split-ring retainer clip to pass therethrough when being forcibly removed from the shaft.

2. The tool of claim 1 wherein said first jaw includes an open receptacle behind said elements for catching a split-ring retainer clip when forcibly removed from a shaft.

3. The tool of claim 1 wherein said second seat means is magnetized for holding a split-ring retainer clip thereon when same is being assembled to a shift.

4. The tool of claim 3 wherein said second seat means includes a semicircular cut out portion having a groove along the perimeter thereof for receiving and maintaining a split-ring retainer in position for assembly to a shaft.

5. The tool of claim 1 wheein said first jaw includes a receptacle behind said first seat means adapted to catch a split-ring retainer clip when forced off of a shaft by operation of said handles with said head in said first position forcibly toward said first jaw.

6. A tool for assembling and disassembling a split-ring retainer clip having free ends from a shaft comprising two cooperating opposing jaws; the first said jaw including a first seat means for receiving a shaft, and the second said jaw having a movable head indexable to two operating positions, said movable head in the first said position having prong means for engaging free ends of a clip to disassemble a clip from a shaft, and said movable head in the second said position having a second seat means to receive a clip with its free ends facing outwardly for assembly of a clip to a shaft, selective means for moving said jaws together, said second jaw including a bifurcated member of two arms, said movable head including a plate member rotatable between said two arms, a pivot pin joining said two arms and said plate member in a rotative relationship, a spring biased pawl mounted on one of said arms, and two spaced indexing recesses on said plate member adapted to receive said pawl to locate said plate in said two operating positions, respectively.

7. The tool of claim 6 wherein said first jaw includes a receptacle behind said first seat means adapted to catch a split-ring retainer clip when forced off of a shaft by operation of said head of said second jaw in said first position forcibly toward said first jaw.

8. The tool of claim 7 wherein said first seat means includes a centrally located opening adapted to permit a split-ring retainer clip to pass therethrough when being removed from a shaft.

9. A tool for assembling and disassembling a split-ring retainer clip having free ends from a shaft comprising two cooperating opposing jaws; the first said jaw including a first seat means for receiving a shaft, and the second said jaw having a movable head indexable to two operating positions, said movable head in the first said position having prong means for engaging free ends of a clip to disassemble a clip from a shaft, and said movable head in the second said position having a second seat means to receive a clip with its free ends facing outwardly for assembly of a split-ring retainer clip to a shaft, selective means for moving said jaws together, said first jaw including a receptacle behind said first seat means adapted to catch a spring clip when forced off of a shaft by operation of said head of said second jaw in said first position forcibly toward said first jaw, said first seat means including a centrally located opening adapted to permit a split-ring retainer clip to pass therethrough when being removed from a shaft.

10. A tool for assembling and disassembling a split-ring retainer clip having free ends from a shaft comprising two cooperating opposing jaws; the first said jaw including a first seat means for receiving a shaft, and the second said jaw having a movable head indexable to two operating positions, said movable head in the first said position having prong means for engaging the free ends of a clip to disassemble a clip from the shaft, and said movable head in the second said position having a second seat means to receive a clip with its free ends facing outwardly for assembly of a clip to a shaft, selective means for moving said jaws together, said head including an elongated rectangular plate with a semicircular cut out portion at each of its two opposite ends thereof, said cut out portions being smaller in diameter than the width of said plate so as to form two prong-like projections at each said end of said plate.

11. The tool of claim 10 wherein one of said ends of said plate includes a groove along the perimeter of the semicircular cut out portion adapted to function as said second seat means to receive and maintain a split-ring retainer clip in position for assembly to a shaft.

12. A hand tool for attaching and detaching from a shaft a split-ring retainer clip having two free ends, said tool comprising a pair of pliers having two elongated handles and a pivot means connecting said handles, first and second jaws attached to respective said handles and adapted to be pressed against each other by squeezing said handles, said first jaw including a generally semicylindrical seat for receiving a shaft and a receptacle behind said seat to catch a split-ring retainer clip when it is detached from said shaft by operation of said tool, said second jaw having a rotatable head indexable to two selective operating positions, means for pivoting said head on said second jaw about an axis lateral to a longitudinal direction of said handles, said head in the first said operating position including a generally semicircular notch between two prongs adapted to contact two free ends of a split-ring retainer clip to remove same from a shaft, said head in the second said operating position including a generally semicircular grooved notch adapted to form a seat for a split-ring retainer clip with its two free ends facing said first jaw to attach a split-ring retainer clip to a shaft.

13. The tool of claim 12 wherein said seat includes a magnetized portion of said head.

14. The tool of claim 12 wherein said head is a flat generally rectangular plate with opposite ends of said plate each having one of said semicircular notches.

15. A hand tool for attaching and detaching from a shaft a split ring retainer clip having two free ends, said tool comprising pliers with first and second jaws that are adapted to be pressed against each other by squeezing two handles, said first jaw including a generally semicylindrical seat for receiving a shaft and a receptacle behind said seat to catch a clip when it is detached from a shaft by operation of said tool, said second jaw having a rotatable head indexable to two selective operating positions, said head in the first said operating position including a generally semicircular notch between two prongs adapted to contact two free ends of a retainer clip, said head in the second said operating position including a generally semicircular grooved notch adapted to form a seat for a retainer clip with its two free ends facing said first jaw, said head being rotatable about a lateral axis to either of said two selective operating positions, said two selective operating positions being located by the cooperation of a spring biased ball in said second jaw and two spaced recesses for said ball in said head.

16. A hand tool for attaching and detaching from a shaft a split ring retainer clip having two free ends, said tool comprising pliers with first and second jaws that are adapted to be pressed against each other by squeezing two handles, said first jaw including a generally semicylindrical seat for receiving a shaft and a receptacle behind said seat to catch a clip when it is detached from a shaft by operation of said tool, said second jaw having a rotatable head indexable to two selective operating positions, said head in the first said operating position including a generally semicircular notch between two prongs adapted to contact two free ends of a retainer clip, said head in the second said operating position including a generally semicircular grooved notch adapted to form a seat for a retainer clip with its two free ends facing said first jaw, said head being rotatable about a lateral axis to either of said two selective operating positions, said head including a bifurcated member of two arms affixed to said second jaw and having a lateral pivot pin adjoining said two arms with a flat plate pivotally attached to said pin between said two arms.

17. A hand tool for attaching and detaching from a shaft a split ring retainer clip having two free ends, said tool comprising pliers with first and second jaws that are adapted to be pressed against each other by squeezing two handles, said first jaw including a generally semicylindrical seat for receiving a shaft and receptacle behind said seat to catch a clip when it is detached from a shaft by operation of said tool, said second jaw having a rotatable head indexable to two selective operating positions, said head in the first said operating position including a generally semicircular notch between two prongs adapted to contact two free ends of a retainer clip, said head in the second said operating position including a generally semicircular grooved notch adapted to form a seat for a retainer clip with its two free ends facing said first jaw, said semicylindrical seat including two parallel spaced semicylindrical members with an intermediate space being adapted to permit passage of a clip therethrough into said receptacle.

18. A hand tool for attaching and detaching from a shaft a split ring retainer clip having two free ends, said tool comprising pliers with first and second jaws that are adapted to be pressed against each other by squeezing two handles, said first jaw including a generally semicylindrical seat for receiving a shaft and a receptacle behind said seat to catch a clip when it is detached from a shaft by operation of said tool, said second jaw having a rotatable head indexable to two selective operating positions, said head in the first said operating position including a generally semicircular notch between two prongs adapted to contact two free ends of a retainer clip, said head in the second said operating position including a generally semicircular grooved notch adapted to form a seat for a retainer clip with its two free ends facing said first jaw, said two selective operating positions being indexed by means of a spring biased ball attached to said second jaw and two spaced depressions in said movable head adapted to receive said ball and hold said head temporarily immovable.

* * * * *